US009154883B2

(12) United States Patent
Wilk

(10) Patent No.: US 9,154,883 B2
(45) Date of Patent: Oct. 6, 2015

(54) LOW RISE SPEAKER ASSEMBLY HAVING A DUAL VOICE COIL DRIVER

(75) Inventor: Christopher Wilk, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 1065 days.

(21) Appl. No.: 13/226,383

(22) Filed: Sep. 6, 2011

(65) Prior Publication Data

US 2013/0058519 A1 Mar. 7, 2013

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 9/02*** | (2006.01) |
| ***H04R 9/04*** | (2006.01) |

(52) U.S. Cl.

CPC ..... *H04R 9/025* (2013.01); *H04R 9/046* (2013.01); *H04R 2209/022* (2013.01); *H04R 2209/041* (2013.01); *H04R 2499/11* (2013.01)

(58) Field of Classification Search

CPC ..... H04R 2499/11; H04R 5/02; H04M 1/035
USPC ..... 381/386, 345, 387, 400, 401
See application file for complete search history.

(56) References Cited

U.S. PATENT DOCUMENTS

| | | | | |
|---|---|---|---|---|
| 4,201,886 | A | 5/1980 | Nagel | |
| 4,591,667 | A | 5/1986 | Hino et al. | |
| 4,752,963 | A | 6/1988 | Yamazaki et al. | |
| 7,317,810 | B2 | 1/2008 | Ohashi | |
| 7,684,586 | B2 | 3/2010 | Shimamura | |
| 7,813,521 | B2 | 10/2010 | Lim | |
| 7,873,179 | B2 * | 1/2011 | Takewa | 381/401 |
| 2002/0064292 | A1 | 5/2002 | Rombach et al. | |
| 2006/0153417 | A1 * | 7/2006 | Furuya | 381/396 |
| 2007/0201718 | A1 | 8/2007 | Shimoe et al. | |
| 2007/0274556 | A1 | 11/2007 | Matsumura et al. | |
| 2008/0226115 | A1 | 9/2008 | Beekman et al. | |
| 2008/0317255 | A1 * | 12/2008 | Cozens et al. | 381/71.6 |
| 2010/0150381 | A1 * | 6/2010 | Lee et al. | 381/190 |
| 2010/0215209 | A1 | 8/2010 | Frasl | |
| 2013/0058519 | A1 * | 3/2013 | Wilk | 381/387 |

FOREIGN PATENT DOCUMENTS

| | | |
|---|---|---|
| CN | 2 794 649 | 7/2006 |

OTHER PUBLICATIONS

Mitchell, J. , "Loudspeakers", Electroacoustic Devices: Microphones and Loudspeakers; Elsevier; edited by Glen Ballou, Part 1, section 2, 2009, 195-221.

(Continued)

*Primary Examiner* — Alexander Jamal
(74) *Attorney, Agent, or Firm* — Blakely, Sokoloff, Taylor & Zafman LLP

(57) ABSTRACT

A speaker assembly includes an enclosure having an acoustic chamber and an acoustic output opening and a speaker driver. The speaker driver includes a sound radiating surface and a first voice coil and a second voice coil positioned along opposite faces, respectively, of the sound radiating surface. The speaker driver further includes a first magnet assembly including an elongated gap in which part of the first voice coil is positioned to vibrate and a second magnet assembly having an elongated gap in which part of the second voice coil is positioned to vibrate. The first magnet assembly elongated gap is orientated lengthwise toward the acoustic chamber, and the second magnet assembly elongated gap is oriented lengthwise toward the acoustic output opening. Other embodiments are also described and claimed.

18 Claims, 6 Drawing Sheets

(56) References Cited

OTHER PUBLICATIONS

PCT International Preliminary Report on Patentability for PCT/US2012/053688, mailed Mar. 20, 2014.

PCT Notification of Transmittal of the International Search Report and Written Opinion of the International Searching Authority, or the Declaration, for the PCT International Appln. No. PCT/US2012/053688, mailed Feb. 6, 2013, (11 pages).

* cited by examiner

LOW RISE SPEAKER ASSEMBLY HAVING A DUAL VOICE COIL DRIVER

BACKGROUND

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones are ubiquitous. These devices, however, do not have sufficient space to house high fidelity speakers. This is also true for portable personal computers such as laptop, notebook, and tablet computers, and, to a lesser extent, desktop personal computers with built-in speakers. Such devices typically require speaker enclosures or boxes that have a relatively low rise (i.e. height as defined along the z-axis) and small back volume, as compared to, for instance, stand alone high fidelity speakers and dedicated digital music systems for handheld media players.

In low rise speaker boxes, there is an advantage to using speakers that maintain a high "Bl" product in order to reduce low frequency displacement (this prevents high total harmonic distortion (THD), rub and buzz) and to increase the sensitivity. In conventional speakers, the magnet unit thickness is typically reduced as the box thickness is reduced to allow for airflow around the transducer. The reduced z height of the magnet system means that the force generated by the coil is smaller (when an audio signal is being applied to the speaker). Therefore, any gains in THD, rub, buzz and sensitivity are lost due to the lower force that is generated by the coil and magnet system. Previous efforts to address this problem have focused on including additional voice coil and magnet systems forming a push pull system within the enclosure to increase the "Bl" product and hence the sound output. Such systems, however, often require a significant increase in the height of the enclosure in order to maintain sufficient air flow through the system.

SUMMARY

An embodiment of the invention is a speaker assembly having an enclosure with an acoustic output opening, an acoustic chamber, and a speaker driver. The speaker driver includes a sound radiating surface, first and second voice coils positioned along opposite faces, respectively, of the sound radiating surface, and first and second magnet assemblies having elongated gaps within which portions of the first and second voice coils are positioned to vibrate. The first magnet assembly elongated gap can be orientated lengthwise toward the acoustic output opening, while the second magnet assembly elongated gap is oriented lengthwise toward the acoustic chamber. The elongated gaps may be used as air flow paths to direct a flow of air toward the acoustic output opening and toward the acoustic chamber so that a height or rise of the enclosure need not be significantly increased to accommodate the stacked voice coil and magnet assembly configuration.

In one embodiment, an angle formed between the lengthwise dimension of the first magnet assembly elongated gap and the lengthwise dimension of the second magnet assembly elongated gap is between 0 degrees and 180 degrees. For example, the angle may be about 90 degrees. This defines a position of the acoustic output opening formed by the enclosure, relative to the acoustic chamber, and allows air flow (produced by the moving sound radiating surface) to be directed in at least two different directions. These directions may be defined by the desired orientation of the acoustic chamber relative to the acoustic output opening.

The above summary does not include an exhaustive list of all aspects of the embodiments disclosed herein. It is contemplated that the embodiments may include all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1:
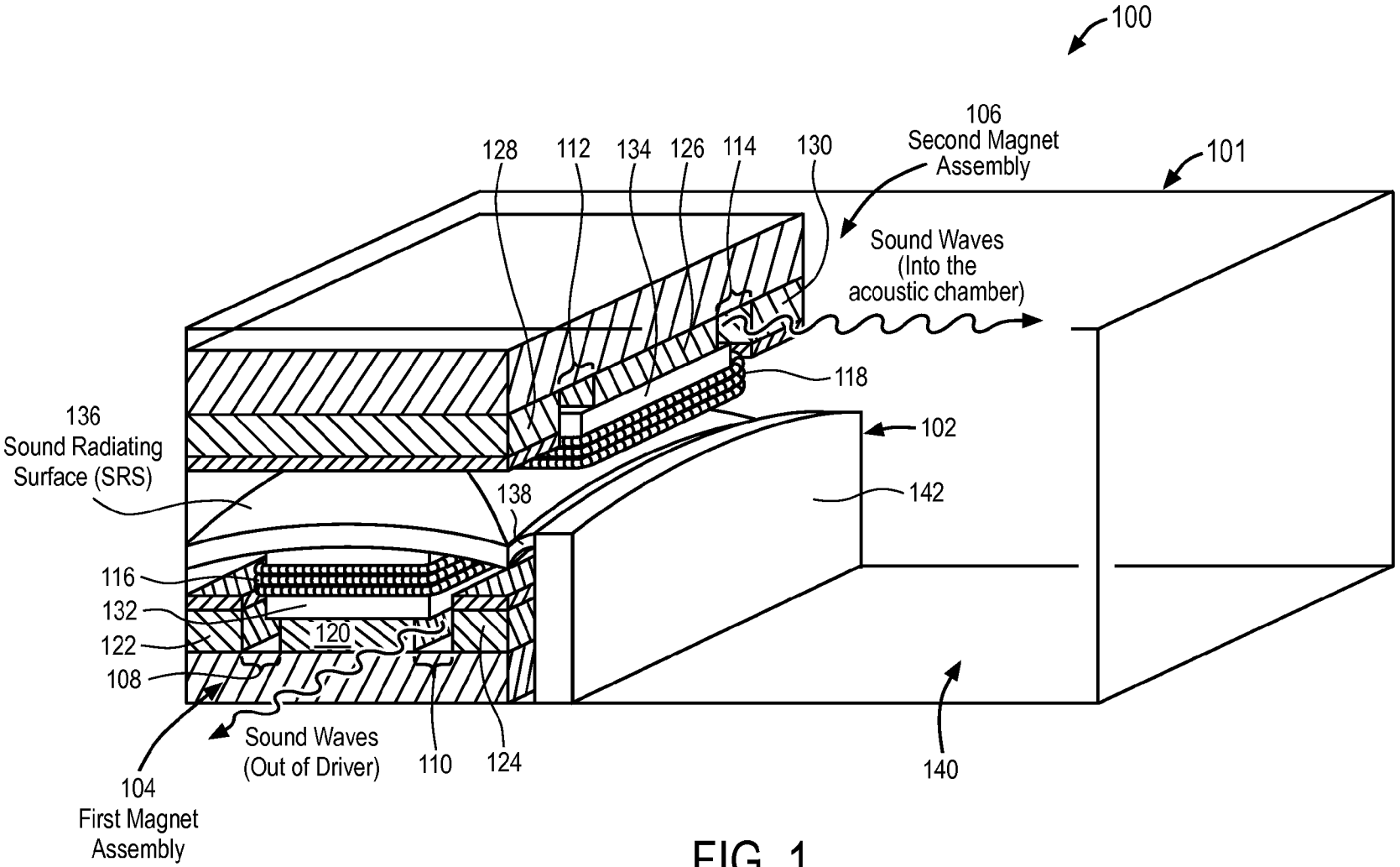
FIG. 1 is a perspective view of a speaker having a dual voice coil driver.
Figure 6:
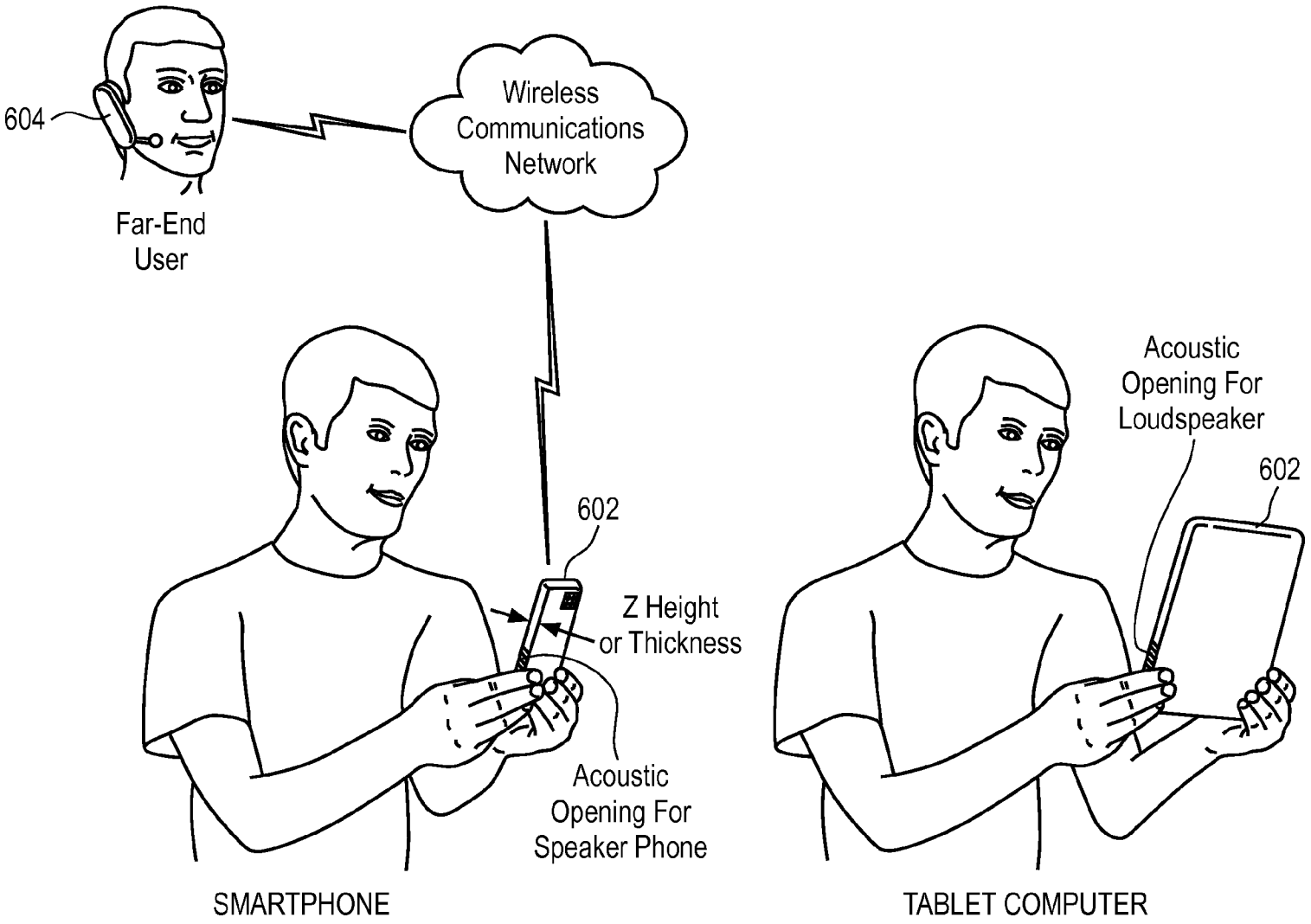
FIG. 6 depicts two instances of consumer electronics devices that typically specify low rise speakers in which the speakers disclosed herein may be implemented.

FIG. 1 is a perspective view of a speaker having a dual voice coil driver. Speaker 100 is built into frame 102 which may be of a typical material used for speaker enclosures, such as plastic. Frame 102 may be part of a speaker enclosure or box 101 whose height (or rise) and speaker back volume 140 (also referred to as an acoustic chamber) are considered to be relatively small. For example, the enclosure height or rise may be in the range of about 8.5 millimeters (mm) to about 10 mm and the speaker back volume or acoustic chamber may be in the range of about 0.25 cubic centimeters (cm) to 2 cubic cm. The concepts described here, however, need not be limited to speaker enclosures whose rise and back volume are within these ranges. As seen in FIG. 6, such a speaker may be a speakerphone unit that is integrated within a consumer electronic device 602 such as a smart phone with which a user can conduct a call with a far-end user of a communications device 604 over a wireless communications network; in another example, the speaker may be integrated within the housing of a tablet computer. These are just two examples of where the speaker may be used.

Speaker 100 may include a dual voice coil driver having first magnet assembly 104 and second magnet assembly 106. FIG. 1 illustrates an embodiment where first magnet assembly 104 and second magnet assembly 106 are positioned along opposite faces of sound radiating surface (SRS) 136. Each of first magnet assembly 104 and second magnet assembly 106 may define gaps within which a portion of coils 116, 118 (also referred to as voice coils), respectively, may be positioned to produce a push pull speaker system. In other words, one of coils 116, 118 acts to "push" sound radiating surface 136 while the other coil simultaneously "pulls" sound radiating surface 136 in the same direction. Sound radiating surface 136 is therefore moved more forcefully which in turn increases "Bl" product and sound output from the device.

Although positioning first magnet assembly 104 and second magnet assembly 106 along opposite faces of sound radiating surface 136 provides several advantages, such a configuration also reduces the space between the face of sound radiating surface 136 and the enclosure. This space is typically reserved for air flow between sound radiating surface 136 and both the back volume of the enclosure and the acoustic output opening. Air flow through speaker 100 is important in order to transmit sound to the user. In addition, air flow helps cool the coils, thereby allowing the speaker to perform well at higher power levels and longer operation intervals.

To maintain space for air flow without substantially increasing a height (or rise) of the enclosure, the gaps 108, 110 formed within first magnet assembly 104 and the gaps 112, 114 formed within second magnet assembly 106 are used as air flow paths. In particular, first magnet assembly 104 may include center magnet piece 120 positioned between outer magnet piece 122 and outer magnet piece 124. First gap 108 may be formed between outer magnet piece 122 and one side of center magnet piece 120 as shown. Second gap 110 may be formed between the other side of center magnet piece 120 and outer magnet piece 124. In an embodiment where outer magnet pieces 122, 124 and center magnet piece 120 have square or rectangular shapes as shown in FIG. 1, gap 108 may run parallel to second gap 110. It is contemplated, however, that outer magnet pieces 122, 124 and center magnet piece 120 may have other shapes. For example, center magnet piece 120 may have a circular or elliptical shape and outer magnet pieces 122, 124 may be arc shaped pieces that have a curve similar to that of a portion of an outer circumference of center magnet piece 120. In such an embodiment, the first and second gaps defined by the magnet pieces may be curved toward one another.

Similar to first magnet assembly 104, second magnet assembly 106 may include first gap 112 formed between one side of center magnet piece 126 and outer magnet piece 128 and second gap 114 may be formed between the other side of center magnet piece 126 and outer magnet piece 130. First gap 112 may run parallel to second gap 114, or in the case of a circular or elliptical center magnet piece, the gaps may be curved toward one another as previously discussed. First magnet assembly 104 and second magnet assembly 106 may be fixed to frame 102. It is further contemplated that speaker 100 may include other magnet assemblies that can provide a sufficiently strong magnetic flux (within a suitably shaped air gap for the coil).

Gaps 108, 110 and gaps 112, 114 may be oriented with respect to one another so that they can direct air flow, and in turn sound waves, in one or more desired directions. For example, first magnet assembly 104 may be positioned such that its gaps 108, 110 are oriented lengthwise in a direction of an acoustic output opening of enclosure 101 while second magnet assembly 106 may be positioned so that its gaps 112,114 are oriented lengthwise in a direction of back volume or acoustic chamber 140 of enclosure 101. Alternatively, gaps 108, 110 may direct air to the acoustic chamber and gaps 112, 114 may direct air to the acoustic output opening.

Air flow through gaps 112, 114 directs sound waves generated by the top face of SRS 136 into chamber 140 while air flow through gaps 108, 110 directs sound waves generated by the bottom face of SRS 136 out of enclosure 101. It is noted that the sound waves generated by opposing faces of SRS 136 are out of phase with one another. It is therefore important to prevent the sound waves generated by the top face of SRS 136 from interacting with sound waves generated by the bottom face of SRS 136. To prevent such interactions, acoustic chamber 140 may be sealed off from the area below the bottom face of SRS 136 by wall 142. Wall 142 may be a substantially rigid structure that is attached to SRS 136 by, for example, gluing one side of suspension 138 to the upper edge of wall 142 and the other side of suspension 138 to SRS 136. Wall 142 may be part of frame 102 or it may be a part of enclosure 101.

Figure 4:
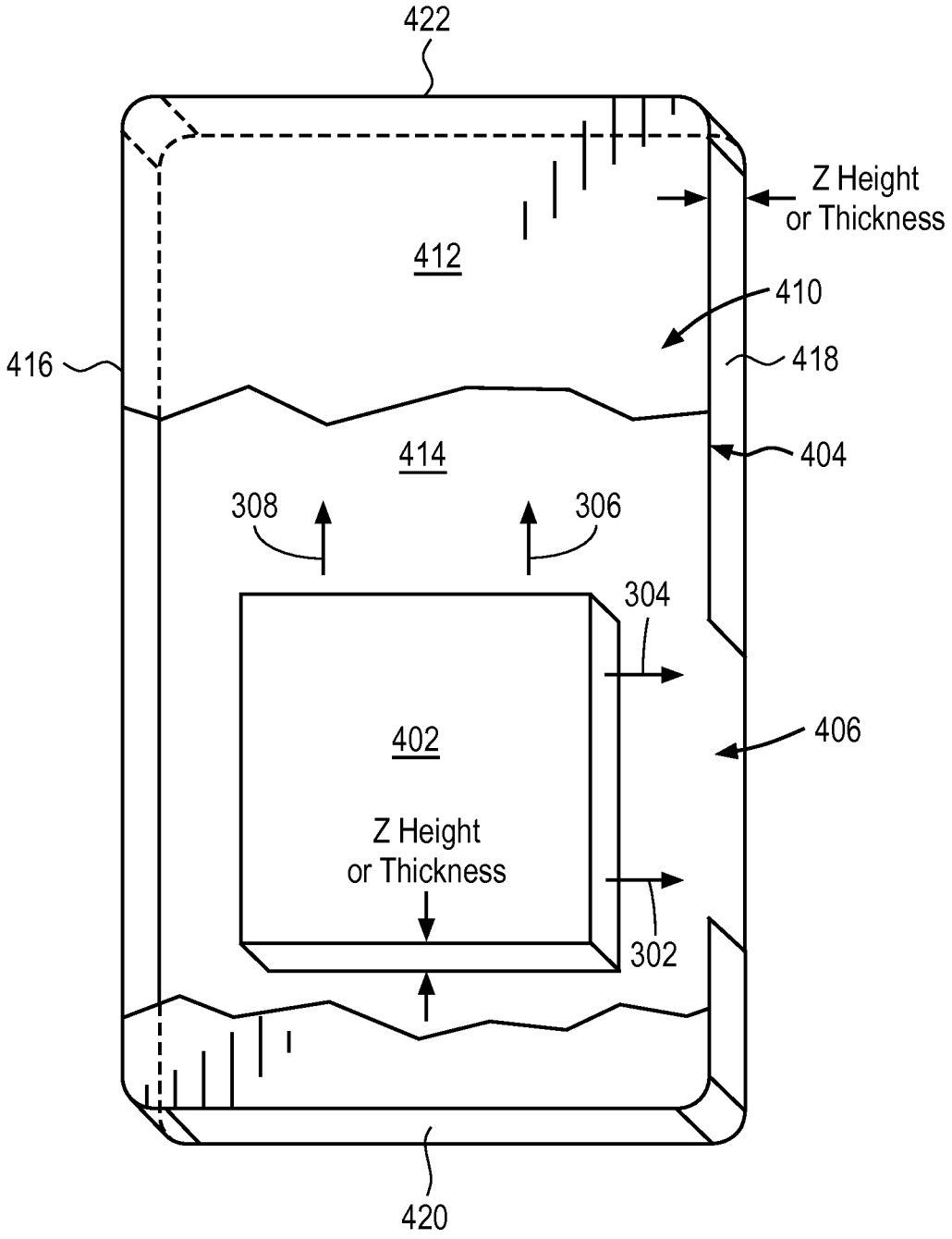
FIG. 4 is a top perspective cut out view of a speaker enclosure having the speaker of FIG. 1 positioned therein.

FIG. 4 illustrates an embodiment where speaker 402, which is substantially the same as speaker 100, directs air flow out of enclosure 404 in a direction of acoustic output opening 406 as illustrated by arrows 302, 304 and back volume 410 as illustrated by arrows 306, 308. As shown in FIG. 4, enclosure 404 includes front face 412 and back face 414 which are joined together by opposing side walls 416, 418, bottom wall 420 and top wall 422. Acoustic output opening 406 is formed within side wall 418. It is contemplated, however, that acoustic output opening 406 may be formed within side wall 416, bottom wall 420 or top wall 422. Back volume 410 is formed between top wall 422, bottom wall 414 and portions of side walls 416, 418. To direct the air flow toward back volume 410 and out acoustic output opening 406 formed in side wall 418 without substantially increasing a rise or height of enclosure 404, speaker 402 is positioned within enclosure 404 so that elongated gaps 108, 110, 112 and 114 are oriented lengthwise within a plane defined by an x-y axis and a height or z height (as defined along the z-axis) of speaker 402 is in the same direction as a z height (also defined along the z-axis) of enclosure 404. In this aspect, air flow out of speaker 100 may be maintained without substantially increasing a rise or height of the enclosure.

Figure 3:
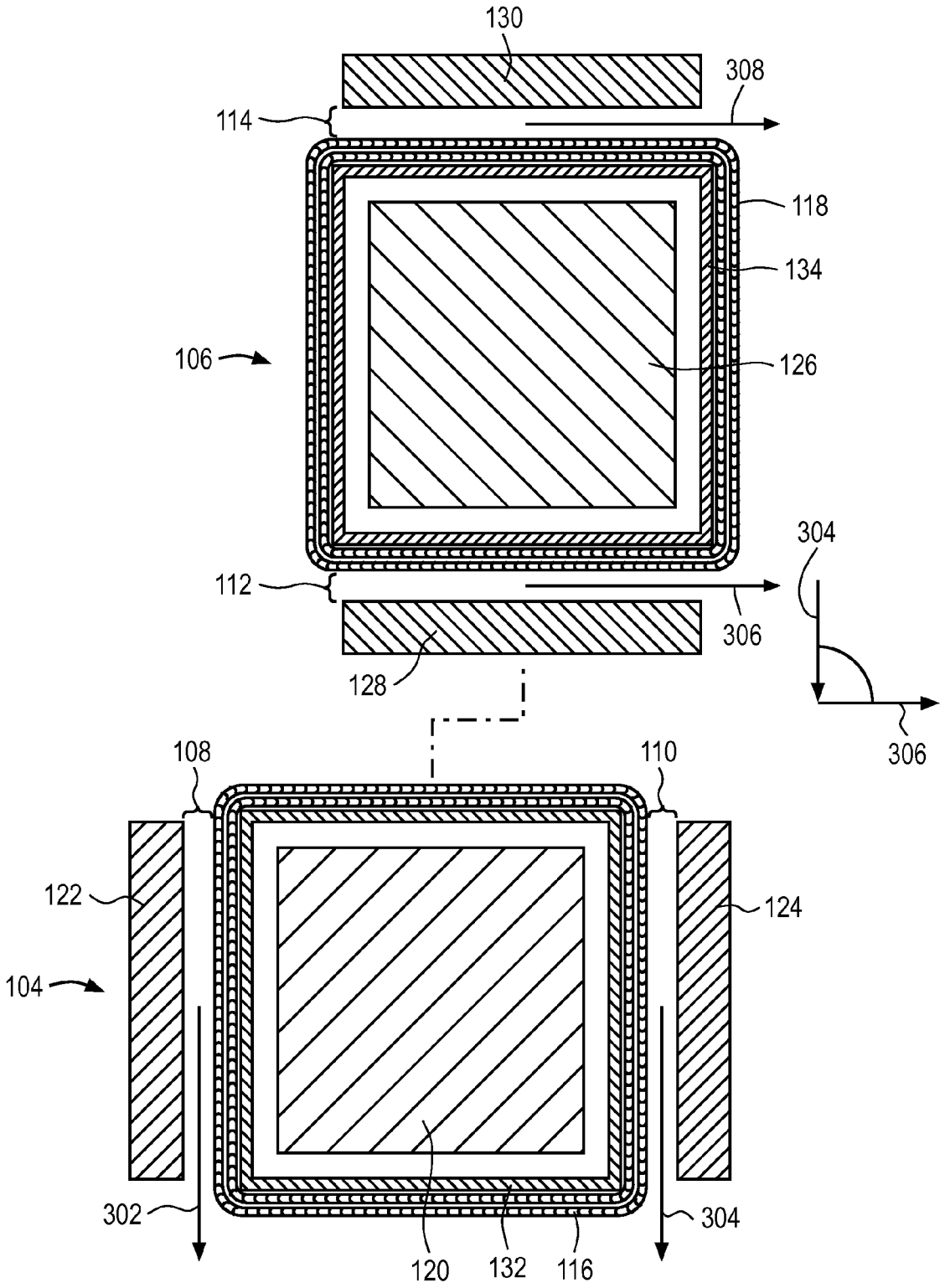
FIG. 3 is a top exploded view of the embodiment of FIG. 1.

Returning to FIG. 1, coil 116, which is affixed to the former 132, may be positioned around center magnet piece 120 (as shown in FIG. 3) and coil 118, which is affixed to former 134, may be positioned around center magnet piece 126. It is noted that although formers 132, 134 are illustrated, formers 132, 134 are optional and may be omitted in some embodiments. Coils 116, 118 may be pre-wound coil assemblies (which include the wire coil held in its intended position by a lacquer or other adhesive material), which may be bonded directly to their respective formers, for example to the outer surface wall of the formers. In other embodiments, formers may be omitted and coils 116, 118 may be attached directly to opposite faces of SRS 136. Other ways of attaching or forming coils 116, 118 in such a fixed position (relative to formers 132, 134) are possible.

Although not shown, coils 116, 118 have electrical connections to a pair of terminals through which an input audio signal is received, in response to which coils 116, 118 produce a changing magnetic field that interacts with the magnetic field produced by magnet assemblies 104, 106, respectively, for providing a driving mechanism for speaker 100. Coils 116, 118 may be pre-wound wire coil units that have been shaped to fit within gaps 108, 110 and gaps 112, 114 of first magnet assembly 104 and second magnet assembly 106, respectively. In this example, coils 116, 118 (and corresponding formers 132, 134) have a substantially square or rectangular shape.

During operation, coils 116, 118 move in parallel to drive movement of sound radiating surface 136. Parallel movement of coils 116, 118 may be controlled by the polar orientation of coils 116, 118 and/or the magnet orientation of first magnet assembly 104 and second magnet assembly 106. For example, magnet pieces 120, 122 and 124 of first magnet assembly 104 and magnet pieces 126, 128 and 130 of second magnet assembly 106 may be oriented so that a direction of the magnetic field generated by first magnet assembly 104 is opposite the direction of the magnetic field generated by second magnet assembly 106. The opposing magnetic fields interact with the magnetic field produced by coils 116, 118 when current is passed through coils 116, 118, causing them to move in parallel, i.e., in a push-pull fashion. Alternatively, the polar orientation of coils 116, 118 may be modified to drive parallel movement of coils 116, 118.

Figure 2A:
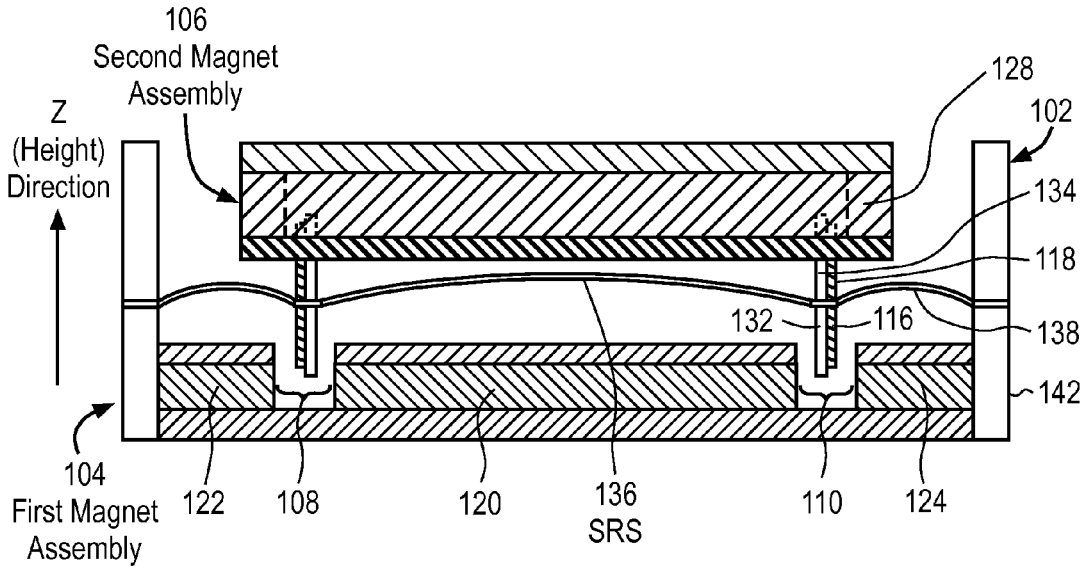
FIG. 2A is a side view of the embodiment of FIG. 1.
Figure 2B:
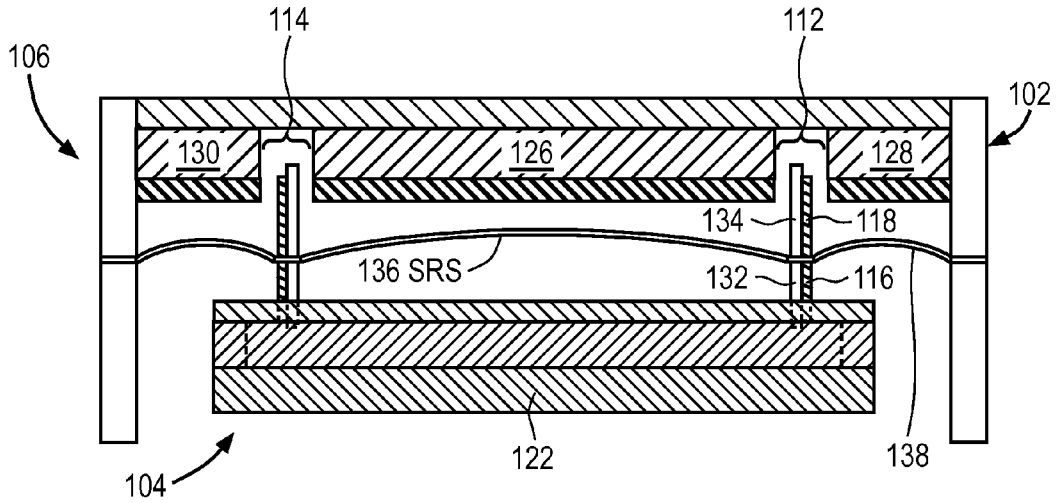
FIG. 2B is a side view of the embodiment of FIG. 1.

Sound radiating surface 136 may be coupled to frame 102 by way of suspension 138 as shown in FIGS. 2A and 2B. Sound radiating surface 136 may be a flat plate, or it may be a dome; the latter is likely to weigh less but may provide less high frequency performance (for the same area size). Suspension 138 allows substantially vertical movement of sound radiating surface 136, that is in a substantially up and down direction or also referred to as a forward-backward direction, relative to fixed frame 102. Suspension 138 may be any flexible material such as foam or rubber or membrane made of a thermoformed plastic that is sufficiently flexible to allow movement of the sound radiating surface in order to produce acoustic or sound waves. The sound radiating surface 136 may be more rigid or less flexible, to be more efficient in producing high frequency acoustic waves. In one instance, suspension 138 is an outer portion of a single-piece flexible membrane, and sound radiating surface 136 includes a rigid plate or dome that may be attached to an inner portion of the flexible membrane. This may be done by directly gluing the sound radiating surface to the top face of the flexible membrane; alternatively, the sound radiating surface may be bonded directly to a top portion of former 132 and a bottom portion of former 134, next to where the flexible membrane is bonded. Suspension 138 may also be viewed as an annular surround that is attached to sound radiating surface 136, along a peripheral portion of the latter. Suspension 138 may also serve to maintain sound radiating surface 136 in substantial alignment relative to a center vertical axis of formers 132, 134 during operation of the speaker. This alignment also serves to prevent a moving coil from getting snagged by the walls of the magnet system.

Former 132 and former 134 may have a typical, generally cylindrical or ring like structure around which a voice coil can be wound. Alternatively, formers 132, 134 may be flat plates with a central opening therein which extends substantially horizontally outward of a peripheral portion of sound radiating surface 136, to a peripheral portion that is separate from suspension 138. In this aspect, sound radiating surface 136 may be attached to a top face of the annular portion of the horizontal former. Formers 132, 134 may be made from any suitably lightweight yet rigid material, so as to keep the weight of the suspended combination with sound radiating surface 136 to a minimum, for greater performance and efficiency. An example material is an aluminum alloy. Other suitable materials include titanium and ceramic, both of which may be made sufficiently lightweight yet rigid.

FIG. 2A and FIG. 2B are side views of the speaker having the dual voice coil driver of FIG. 1. FIG. 2A shows a side of speaker 100 facing a side wall of the enclosure. FIG. 2B shows a side of speaker 100 facing a front or back wall of the enclosure. These views illustrate the alignment and positioning of first magnet assembly 104 and second magnet assembly 106 along opposite faces of sound radiating surface 136. First magnet assembly 104 is positioned along a bottom face of sound radiating surface 136 and second magnet assembly 106 is positioned along a top face of sound radiating surface 136. It is contemplated, however, that first magnet assembly 104 and second magnet assembly 106 may be positioned along different faces of sound radiating surface 136. First magnet assembly is oriented such that its first gap 108 and second gap 110 extend lengthwise into the page. Second magnet assembly 106 is oriented such that the length dimension of its first gap 112 and second gap 114 form about a 90 degree angle with the first gap 108 and second gap 110. This orientation is illustrated in the spread apart view of FIG. 3, where it should be understood that the magnet assemblies 104, 106 are actually stacked. In particular, first magnet assembly 104 includes first gap 108 and second gap 110 oriented in a lengthwise direction perpendicular to first gap 112 and second gap 114 of second magnet assembly 106. Such orientation directs air flow (caused by up and down vibration of SRS 136) in two different directions perpendicular to one another. Representatively, air flows through first gap 108 and second gap 110 of first magnet assembly 104 in a first direction illustrated by arrows 302, 304, respectively, while air flows through first gap 112 and second gap 114 of second magnet assembly 106 in a second direction illustrated by arrows 306, 308, respectively. According to this example, gaps 108, 110, and in turn, air flow in the first direction (along arrows 302, 304) is perpendicular, or at a 90 degree angle ($\alpha$), to gaps 112, 114, and in turn, air flow in the second direction (along arrows 306, 308). By directing air flow in this manner, a sufficient volume of air flow can be directed between the back volume (see 410 of FIG. 4) and the acoustic output opening (see 406 of FIG. 4) of the enclosure (see 404 of FIG. 4).

Although arrows 302, 304 and arrows 306, 308 illustrate air flow through gaps 108, 110 and gaps 112, 114, respectively, in a single direction, it should be understood that each of gaps 108, 110 and gaps 112, 114 may accommodate bidirectional air flow. As illustrated in FIG. 1, enclosure 101 includes vertically extending side walls that are positioned around first magnet assembly 104 and second magnet assembly 106. Portions of the walls positioned at the end of gaps 108, 110 and/or gaps 112, 114 impede air flow out of gaps 108, 110 and/or gaps 112, 114 in the direction of the wall. Instead, air will travel out the end of gaps 108, 110 and/or gaps 112, 114 directed toward the back volume or the acoustic output opening. Where additional openings are included in the enclosure, for example acoustic output openings and/or air vents along both ends of gaps 108, 110 and/or gaps 112, 114, air flow may be bidirectional and out both ends of the gaps.

Figure 5:
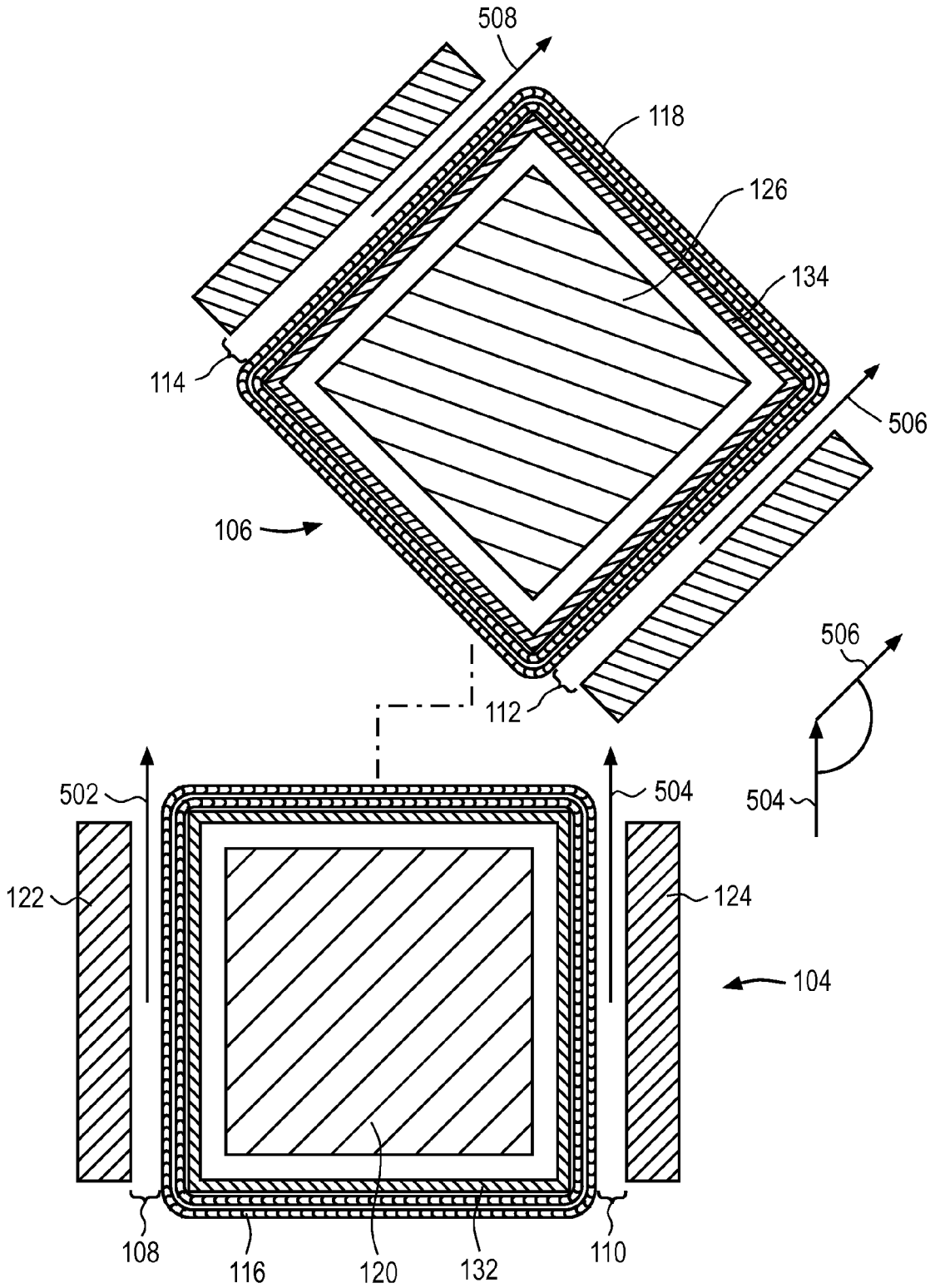
FIG. 5 is a top exploded view of another embodiment of a speaker having a dual voice coil driver.

The magnet assembly orientation illustrated in FIG. 3 is desirable where acoustic output opening 406 is positioned along a side of enclosure 404 as illustrated in FIG. 4. In embodiments where the acoustic output opening is positioned along a different portion of enclosure 404, for example, along back volume 410, first magnet assembly 104 and second magnet assembly 106 may be oriented as illustrated in FIG. 5. In this embodiment, first air gap 112 and second air gap 114 of second magnet assembly 106 are oriented in a lengthwise direction toward an upper right hand corner of the enclosure (e.g. enclosure 404) and first gap 108 and second gap 110 of first magnet assembly 104 are oriented in a lengthwise direction toward the back volume. As such, an angle formed by first magnet assembly elongated gaps 108, 110, and in turn, air flow in the first direction (along arrows 502, 504) and second magnet assembly elongated gaps 112, 114, and in turn, air flow in the second direction (along arrows 506, 508) is greater than 90 degrees, for example at an angle of about 135 degrees (θ). In this aspect, air flow is directed by first magnet assembly 104 along air flow paths 502, 504 toward a back volume and by second magnet assembly 106 along air flow paths 506, 508 toward a side of the enclosure defining the back volume.

Although two different magnet assembly orientations are illustrated in FIG. 3 and FIG. 5, it is contemplated that first magnet assembly 104 and second magnet assembly 106 may be oriented in any manner desired so that their respective gaps direct an air flow to a desired portion of the enclosure. Representatively, an angle formed by elongated gaps 108, 110 of first magnet assembly 104 and gaps 112, 114 of second magnet assembly 106 may be between 0 degrees and 180 degrees, for example, from about 45 degrees to about 135 degrees, or about 90 degrees. Alternatively, gaps 108, 110 and gaps 112, 114 may be aligned in parallel such that they form a 0 or 180 degree angle with respect to one another.

A process of manufacturing the speaker described above, and in particular the assembly that includes first magnet assembly 104 attached to coil 116 and former 132, second magnet assembly 106 attached to coil 118 and former 134, suspension 138 and sound radiating surface 136 may proceed as follows. Coils 116, 118 may be obtained as pre-wound units, which are then secured to formers 132, 134, respectively, along the outer elongated walls. Next, sound radiating surface 136, which may be a rigid plate or dome is attached to a top end of former 132 and a bottom end of former 134. At the same time, or just before or just after, an inner region of the suspension 138 is attached to the top end of former 132 and the bottom end of former 134. Formers 132, 134 having coils 116, 118 positioned thereon, are then positioned within gaps of first magnet assembly 104 and second magnet assembly 106, respectively. Alternatively, in embodiments where formers 132, 134 are omitted, coils 116, 118 and suspension 138 may be attached directly to sound radiating surface 136.

In the above manufacturing process, formers 132, 134 may have been manufactured as separate pieces than sound radiating surface 136. However, as an alternative, formers 132, 134 and sound radiating surface 136 may be manufactured as a single piece. Such a former-radiating surface element could be milled, cut or stamped from a solid sheet of material such as aluminum alloy (or other suitably lightweight yet rigid material). The manufacturing process would otherwise remain the same.

While certain embodiments have been described and shown in the accompanying drawings, it is to be understood that such embodiments are merely illustrative of and not restrictive, and that the embodiments disclosed herein are not limited to the specific constructions and arrangements shown and described, since various other modifications may occur to those of ordinary skill in the art. For example, although the drawings show the gap in the magnet system, the coil, and the horizontal former all having essentially the same rectangular or square shape, an alternative may be a substantially elliptical or oval shape or even round in shape. The description is thus to be regarded as illustrative instead of limiting.

What is claimed is:

1. A speaker assembly comprising:

an enclosure having an acoustic chamber and an acoustic output opening; and a speaker driver having, a sound radiating surface, a first voice coil and a second voice coil positioned along opposite faces, respectively, of the sound radiating surface, a first magnet assembly having an elongated gap in which part of the first voice coil is positioned to vibrate, and a second magnet assembly having an elongated gap in which part of the second voice coil is positioned to vibrate, wherein the first magnet assembly elongated gap is orientated lengthwise toward the acoustic chamber, and the second magnet assembly elongated gap is oriented lengthwise toward the acoustic output opening.

2. The speaker assembly of claim 1 wherein an angle formed between the lengthwise dimension of the first magnet assembly elongated gap and the lengthwise dimension of the second magnet assembly elongated gap is between 0 degrees and 180 degrees.

3. The speaker assembly of claim 1 wherein the first magnetic assembly elongated gap directs air flow in a first direction and the second magnetic assembly elongated gap directs air flow in a second direction different from the first direction.

4. The speaker assembly of claim 3 wherein the first direction is substantially perpendicular to the second direction.

5. The speaker assembly of claim 1 wherein the first voice coil and the second voice coil move in parallel to drive movement of the sound radiating surface.

6. The speaker assembly of claim 1 wherein the elongated gap of the first magnet assembly is a first elongated gap and the first magnet assembly defines a second elongated gap parallel to the first elongated gap.

7. The speaker assembly of claim 1 wherein the elongated gap of the second magnet assembly is a first elongated gap and the second magnet assembly defines a second elongated gap parallel to the first elongated gap.

8. The speaker assembly of claim 1 wherein a z height of the speaker driver is oriented in substantially the same direction as a z height of the enclosure.

9. A speaker comprising:

a frame;

a sound radiating surface;

a first voice coil and a second voice coil positioned along opposite faces, respectively, of the sound radiating surface;

a first magnet assembly defining an elongated gap in which part of the first voice coil is positioned to vibrate; and a second magnet assembly defining an elongated gap in which part of the second voice coil is positioned to vibrate, wherein a length dimension of the first magnet assembly elongated gap is oriented in a different direction than a length dimension of the second magnet assembly elongated gap.

10. The speaker of claim 9 wherein an angle formed by the length dimension of the first magnet assembly elongated gap and the length dimension of the second magnetic assembly elongated gap is between 0 degrees and 180 degrees.

11. The speaker of claim 9 wherein the first magnetic assembly elongated gap directs air in a first direction and the second magnetic assembly elongated gap directs air in a second direction.

12. The speaker of claim 11 wherein the first direction is substantially perpendicular to the second direction.

13. The speaker of claim 9 wherein the first voice coil and the second voice coil move in parallel to drive movement of the sound radiating surface.

14. A portable audio device comprising:

an enclosure having a front face, a back face, at least one side wall connecting the front face to the back face, an acoustic chamber formed between the front face and the back face and an acoustic output opening formed within the at least one side wall;

a diaphragm positioned within the enclosure;

a first voice coil and a second voice coil positioned along opposite faces, respectively, of the diaphragm;

a first magnet assembly in which part of the first voice coil is positioned to vibrate; and a second magnetic assembly in which part of the second voice coil is positioned to vibrate, wherein the first magnet assembly is dimensioned to direct air flow to the acoustic chamber and the second magnetic assembly is dimensioned to direct air flow toward the acoustic output opening.

15. The portable audio device of claim 14 wherein the first magnet assembly defines at least one elongated gap dimensioned to receive the first voice coil and direct air flow to the acoustic chamber and the second magnet assembly defines at least one elongated gap dimensioned to receive the second voice coil and direct air flow to the acoustic output opening.

16. The portable audio device of claim 15 wherein an angle formed between a lengthwise dimension of the first magnet assembly elongated gap and a lengthwise dimension of the second magnet assembly elongated gap is between 0 degrees and 180 degrees.

17. The portable audio device of claim 15 wherein the first magnetic assembly elongated gap directs air flow in a first direction and the second magnetic assembly elongated gap directs air flow in a second direction different from the first direction.

18. The portable audio device of claim 17 wherein the first direction is substantially perpendicular to the second direction.

* * * * *